United States Patent [19]

Johnson, Jr. et al.

[11] Patent Number: 5,060,802

[45] Date of Patent: Oct. 29, 1991

[54] DIVIDABLE CARTONS

[75] Inventors: A. David Johnson, Jr., Berwyn; Joseph L. Bachman, Jr., Wayne, both of Pa.

[73] Assignee: Wayne Automation Corporation, Norristown, Pa.

[21] Appl. No.: 637,195

[22] Filed: Jan. 3, 1991

Related U.S. Application Data

[63] Continuation of Ser. No. 504,849, Apr. 5, 1989, abandoned.

[51] Int. Cl.[5] ..... B65D 5/54; B65D 5/48

[52] U.S. Cl. ..... 206/602; 229/120.35; 229/120.38

[58] Field of Search ..... 206/602; 229/23 R, 120.03, 229/120.23, 120.26, 120.18, 120.35, 120.37, 120.38, 915, 916, DIG. 11

[56] References Cited

U.S. PATENT DOCUMENTS

| | | | |
|---|---|---|---|
| 2,012,132 | 8/1935 | Koppelman et al. | 229/120.03 |
| 2,448,795 | 9/1948 | Grecco | 206/602 |
| 2,710,130 | 6/1955 | Grecco | 206/602 |
| 3,082,929 | 3/1963 | Aquino et al. | 206/602 |
| 3,252,646 | 5/1966 | Rockefeller | 206/602 |
| 3,412,920 | 11/1968 | Desforges | 229/915 |
| 3,921,893 | 11/1975 | Randle, Jr. | 229/23 R |
| 4,529,117 | 7/1985 | Brundage | 206/602 |
| 4,793,494 | 12/1988 | Gordon, Jr. | 206/602 |
| 4,826,016 | 5/1989 | Foster | 206/602 |
| 4,913,291 | 4/1990 | Schuster | 206/602 |

FOREIGN PATENT DOCUMENTS

| | | | |
|---|---|---|---|
| 382645 | 9/1964 | Switzerland | 206/602 |

*Primary Examiner*—Gary E. Elkins

*Attorney, Agent, or Firm*—Frederick J. Olsson

[57] ABSTRACT

In a dividable shipping carton, there are abutting C-shaped dividers which angled or chamfered to provide a space adjacent each side wall, each being dimensioned to receive the blade of a severing knife and to continue to receive the blade even with substantial deviation of the blade from the guide line and thereby prevent cutting of plastic bottles, etc. inside the carton.

1 Claim, 3 Drawing Sheets

DIVIDABLE CARTONS

This application is a continuation of our copending application Ser. No. 504,849 filed Apr. 5, 1990 and now abandoned.

The invention in general relates to corrugated shipping cartons or containers employed to ship a plurality of items which may be of the container type or of the non-container type.

More particulary the invention relates to shipping cartons or containers having internal partition means separating the items into groups, the arrangement providing that by cutting along exterior guide line means the carton can be divided into smaller independent shipping cartons.

A major defect in the design of such divisible cartons or containers is that where the path of the knife blade moving along guide line means on a side wall deviates from the line by a small amount, the blade cuts into one of the items in the carton.

The invention provides improvements in the partition means which functions to essentially eliminate the likelihood that an item in a carton will be cut even with abnormal deviation of a knife blade from the guide line on a side wall.

The invention contemplates that the partition means be structured to provide spaces inside the carton or shipping container each of which is adjacent to a side wall and co-extensive with the external knife-blade guide line means, each space being dimensioned to receive the end of knife blade being moved along the guide line and cutting the wall and to continue to receive the end of the blade even with substantial deviation from the guide line to thereby maintain the knife blade away from items in the carton and prevent the cutting of same.

The invention in one aspect, contemplates partition means in the form of a pair of C or U shaped dividers inside of a shipping carton, the respective bases of the dividers being closely adjacent to or abutting one another and the legs of the dividers being respectively glued to opposite side walls, the aforementioned knife-receiving spaces being provided by that each leg is joined to its base by space-providing structure preferably a chamfer.

The invention will be shown as employed in shipping medium such as a conventional four-panel corrugated carton or container (regular slotted carton) and as employed in a conventional five panel wrap around carton or container the foregoing being described below in connection with the following drawings wherein. It will be understood of course that the invention can be employed in a ½ slotted carton.

As previously mentioned, the partition means of the invention may be created by a pair of C-shaped dividers and typical blanks for forming such dividers are described in connection with FIG. 1 and 2.

Figure 1:
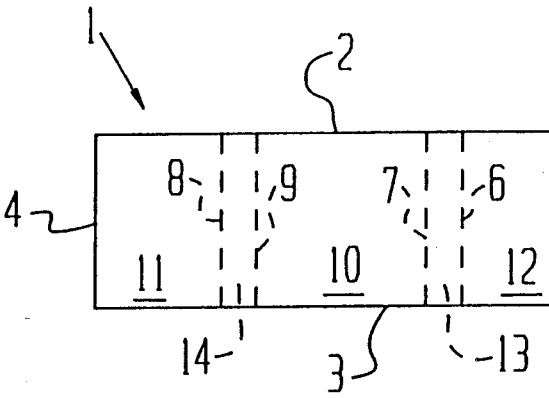
FIG. 1 is a plan view of a divider blank.

In FIG. 1, the blank is rectangular in shape and has parallel top and bottom edges 2 and 3 and parallel side edge 4 and 5 which are normal to the edges 2 and 3.

A first pair of spaced-apart, parallel score lines 6 and 7 extend between the top and bottom edges 2 and 3. A second pair of score lines 8 and 9 are parallel to the first pair and also extend between the edges 2 and 3. The score lines 6, 7 and 8, 9 determine the bend lines for the blank.

The score lines 6, 7 and 8, 9 may be formed after the blank is die cut either by rollers working on opposite sides of the blank or by knife means making a ½ cut—½ land pattern.

Each area 10 between the pairs of score lines will, after folding, constitute a base of a divider and each of the areas 11 and 12 will constitute the legs of a divider.

The areas 13 and 14 between the score lines 6 and 7 and between the score lines 8 and 9 are juncture areas between the base 10 and the respective legs 11 and 12. There areas provide the heretofore mentioned knife receiving spaces as will be explained more in detail later.

Figure 2:
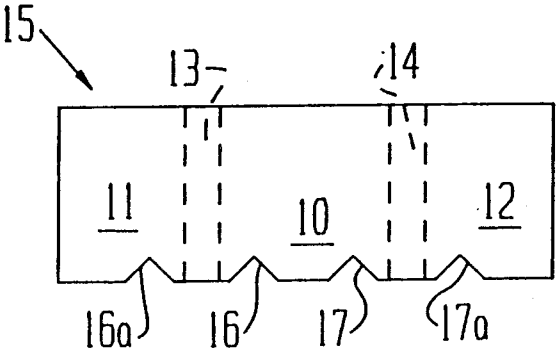
FIG. 2 is a plan view of a modified divider blank.

The blank 15 of FIG. 2 has the same construction as the blank 1. The same numbers (except for a modification) have been applied to corresponding parts. The modification is the provision of lead-in cutouts 16 and 17 on the bottom edge 3 within the base 10. Depending upon the characteristics of the items to be packed, lead in-cut outs may be provided on the bottom edge 3 respectively in the leg areas 11 and 12 as is noted at 16*a* and 17*a*.

Figure 3:
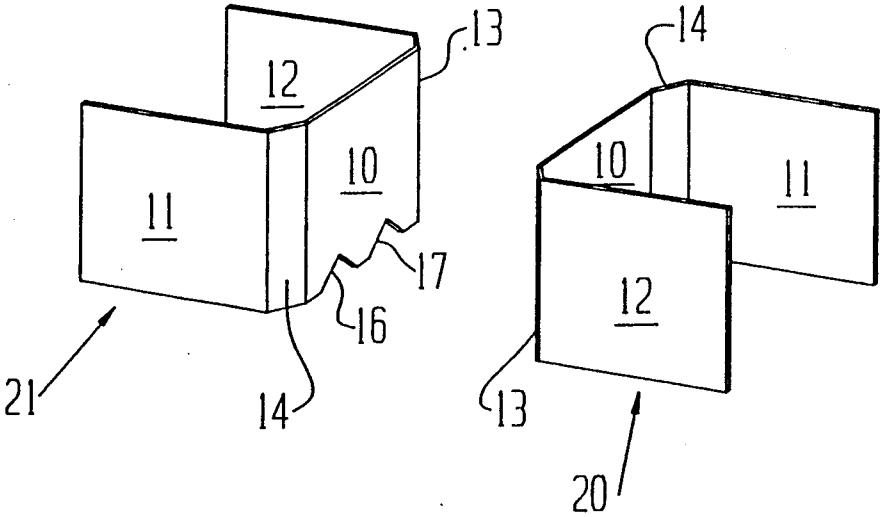
FIG. 3 is a view showing a pair of C-shaped dividers formed from the blank of FIG. 2.

Continuing with formation of the preferred partition means, a pair of blanks 15 such as shown Figure (or a pair of blanks 1 such as shown FIG. 1) are folded or bent into C-shaped dividers such as dividers 20 and 21 shown in FIG. 3. These dividers are inserted into a shipping carton using conventional automatic bending and inserting equipment. Normally, before inserting the dividers, the carton will have been loaded with items to be shipped so that the dividers are slipped down between adjacent rows of items with the bases closely adjacent or abutting.

Figure 4:
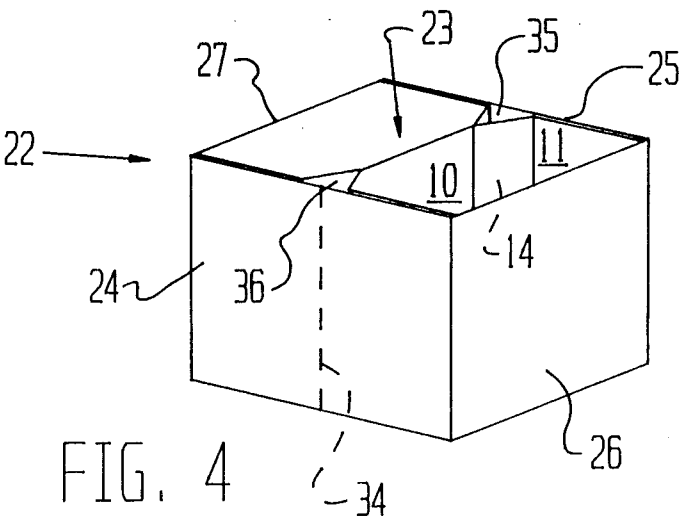
FIG. 4 illustrates a 4 panel shipping carton or container (with the minor and major flaps not shown for purposes of clarity) and having C-shaped dividers of FIG. 3 inserted therein.

The four panel shipping carton or container 22 of FIG. 4 (flaps removed) is shown without any items inside but with the dividers in place to form the partition means 23. The carton 22 has a pair of opposite side walls 24 and 25, a pair of opposite end walls 26 and 27. The top wall 28 (shown in FIG. 6) is comprised of the major flaps 30 and 31 and minor flaps 32 and 33 folded over and glued together. The bottom wall is formed by similar major and minor flaps folded over and glued to one another.

The four panel carton 22 is formed from a die cut blank and concurrently with the die cutting, knife guide line means are applied to those parts of the blank corresponding to the side walls and to the major top and bottom flaps.

Figure 5:
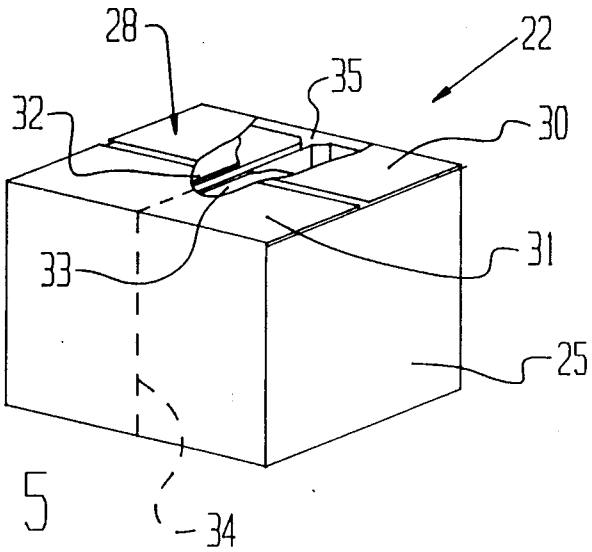
FIG. 5 is a view illustrating the carton or container of FIG. 4 with the C-shaped dividers inserted and with the minor and major flaps closed, parts of the major flaps being broke away to show the minor flaps (also broken away) and the C-shaped dividers.

The guide line means may be done by printing or by ½ cut—½ land scoring. In FIGS. 4 and 5 the guide means is indicated at 34. The guide line means normally extends completely around the periphery of the carton.

Returning now to the dividers 20 and 21, each divider is dimensioned so that as disposed in the carton the legs 10 and 11 engage the respective side walls 23 and 24. The bases 10 extend in a direction between the side walls 23 and 24 and are closely adjacent and preferably abutting one another.

Prior the insertion, the outside surfaces of the legs 11 and 12 are provided with a pattern of quick-set glue and after insertion, the legs and side walls are pressed together while the glue sets to bond the legs and side walls together. The bases 10 are not glued as each will become a side wall of a divided smaller carton.

Figure 6:
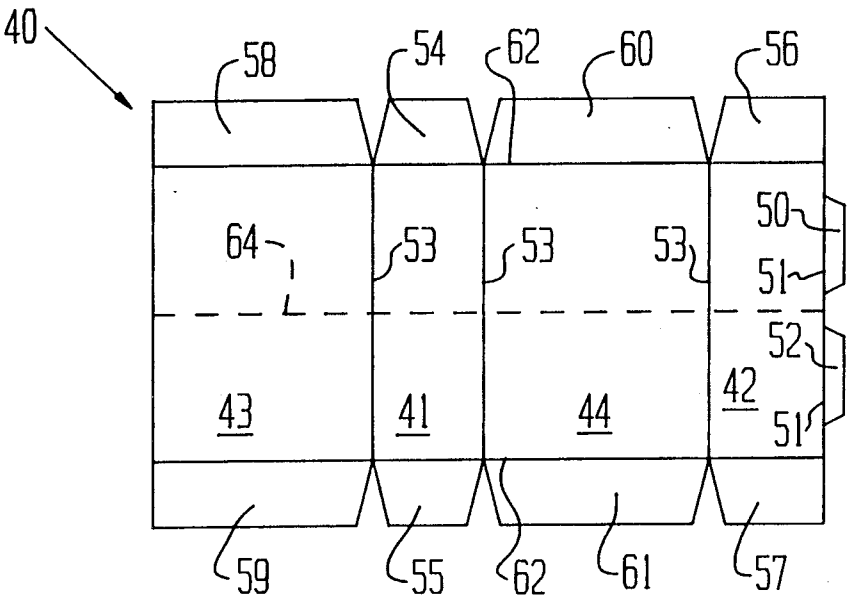
FIG. 6 is a plan view of a blank for a five panel wrap around carton or container.

The bases and legs of the divider extend between the top and bottom walls and preferably engage the underside of same when the top wall is closed as shown in FIG. 6.

The bases 10 by extending centrally of the cartons and divide the items in the carton into two separate groups which usually will have the same number of items.

Returning now to the lead-in cutouts 16 and 17 (and 16*a*, 17*a*), these are important for insertion purposes especially with continuously operating equipment which processes container-type items (for liquid) formed with a small diameter pour-stem surrounded by an essentially flat area constituting the top of the container.

Where such containers are not precisely positioned, a divider may engage and be stopped by the top and cause the machine to jam. With cut-outs having a width a little greater than the container diameter, the divider is led in between adjacent rows of containers and machine jamming eliminated.

The prime function of the invention, that is to say, the providing of partition means which creates knife receiving spaces along the inside of the side walls to avoid cutting of items in the carton will now be explained.

Referring to FIG. 3 and 4 it will be apparent that when the blanks are bent or folded into the C-shape, each juncture or joinder area 13 and 14 between a base and a leg becomes contoured; i.e., assumes an angle posture so that in these areas the divider is chamfered. When the dividers are inserted the angled or chamfered condition creates the spaces or cutting zones indicated at 35 and 36. These spaces or cutting zones are adjacent the side walls 24 and 25 and are co-extensive with the side walls and the respective knife guide line means thereon.

For cutting dividable cartons along the knife guide lines means it is conventional to employ a utility knife with the blade inserted through the wall and the handle of the knife abutting the outside surface of the wall. In that condition, the knife is moved along the guide line means. The engagement of the handle with the side wall has a stabilizing effect. More often than not however, the operator does not engage the handle with the wall and there is no stabilizing effect. Sometimes a hooked-blade carpet knife is used and in these cases the handle does not abut the surface of the outer wall. There is no stabilizing factor.

In either case, the non-stabilization leads to deviation of the blade from the guide line.

Without the spaces or cutting zones 35 and 36, the deviation of the knife blade causes engagement and cutting of an item in the carton.

It is pointed out that blade deviation on the top and bottom walls is not as serious as deviation on the side walls. This is particulary the case with round containers, because the amount of material which might be exposed t the blade is limited.

Thus, with the above in mind, it will be understood that the structure or dimensions of the partition means is chosen so that with both non-deviation and with substantial deviation (such as by $\frac{1}{4}$''), the tip of the blade will still be received and remain in a space and the items unharmed.

Figure 7:
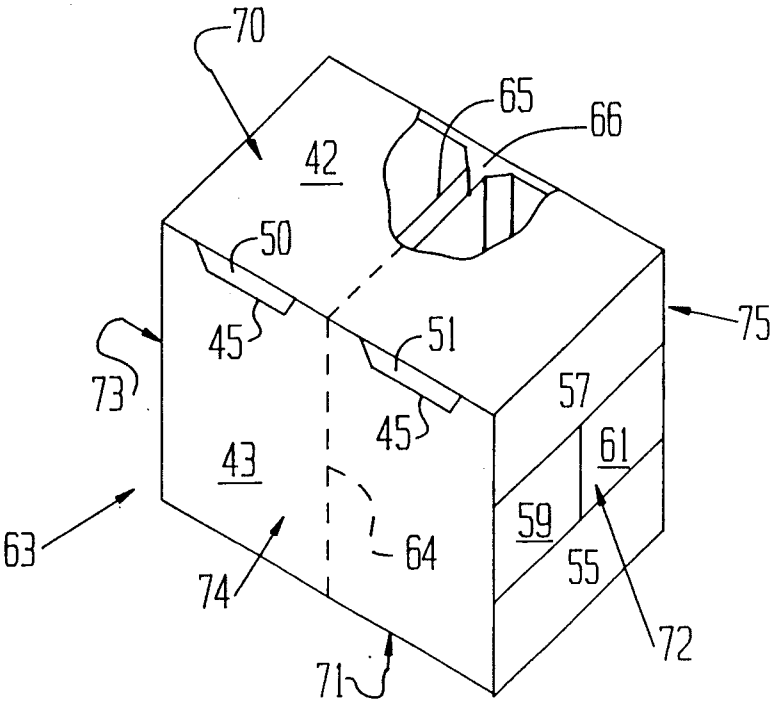
FIG. 7 is a view showing the blank of FIG. 6 fully erected and with part of the top wall cut away to show the C-shaped dividers in place.

In FIG. 6 and 7 respectively illustrates a five panel wrap around blank and shipping medium incorporating the invention.

In FIG. 6 blank 40 has a bottom panel 41, a top panel 42, a rear or trailing side panel 43 and a front or leading side panel 44 and closure panel 45 which in this case is a pair of short, small flaps 50 and 51 which extend outwardly from the top panel 42. For purposes of folding or bending, a roller-type score line 52 is provided between the top panel 42 and flaps 50 and 51. Similar score lines 53 are provided between bottom panel 41, the rear and front side panels 43 and 44 and between the front panel 44 and top panel 42.

The bottom panel 41 has lower minor end flaps 54 and 55, the top panel 42 has upper minor end flaps 56 and 57. The rear side panel 43 has major end flaps 58 and 59 and the front side panel 44 has major end flaps 60 and 61. For bending purposes, score lines 62 are provided between the end flaps and side panels.

The blank 40 is fully erected into a shipping medium as noted at 63 (FIG. 7) with the items therein by automatic equipment as explained in our application filed concurrently herewith, suffice it to say at this point that the items to be shipped are placed in a 5-panel wrap around shipping medium ready to be sent to inventory or shipped out by that a group of items and partitions means therefor are put into position on a flat section of a partially erected, non-glued (but held firm), blank and thereafter the blank is fully erected into the shipping medium for the items.

In the shipping medium 63 of FIG. 7 the corresponding panel and flaps have the same numbers as used in FIG. 6. The top 42 is cut away to show the partition means 65.

During the erection process, the small flaps 50 and 51 are glued to the rear panel 43 and the minor end flaps 55 and 57 are glued to the major end flaps 59 and 61. The minor flaps 54, 56, and major flaps 58 and 60 are similarly glued.

The blank 40 is provided with a knife blade guide means indicated at 64 in FIG. 5 and 6.

The partition means 65 is comprised of C-shaped dividers having a construction as previously described and are inserted, and glued during the erection of the wrap around blank.

One of the knife receiving spaces formed by the partition means 63 is indicated at 66.

It will be apparent that the fully erected and glued carton or shipping medium 63 has top wall 70, bottom wall 71, end walls 72 and 73, and side walls 74 and 75. The carton 63 is the closed type and is generally rectangular in shape. It will be understood that the term "rectangular" is inclusive of the term square.

We claim:

1. A blank for forming a U-shaped divider to be placed into subdividable carton:

a generally rectangular shaped piece of corrugated sheet stock;

a first pair of spaced apart, parallel score lines extending between a pair of oppositely disposed edges, each score line of the first pair being for use in determining a fold lien;

a second pair of spaced apart, parallel score lines spaced from said first pair and extending between said pair of oppositely disposed edges, each score line of the second pair being parallel said score lines of said first pair and said score lines of the second pair being for use in determining a fold lien; and along one of said opposite edges, a plurality of spaced apart, lead-in cutouts.

* * * * *